United States Patent [19]

Hannon

[11] 4,219,987

[45] Sep. 2, 1980

[54] METHOD FOR SKIN PACKAGING USING PLATEN FORMING OF THE FILM, AND PACKAGES PRODUCED THEREBY

[75] Inventor: James V. Hannon, New Britain, Conn.

[73] Assignee: Diversified Packaging, Incorporated, Kensington, Conn.

[21] Appl. No.: 24,064

[22] Filed: Mar. 26, 1979

Related U.S. Application Data

[62] Division of Ser. No. 801,097, May 26, 1977, Pat. No. 4,145,863.

[51] Int. Cl.[3] ..... B65B 11/52

[52] U.S. Cl. ..... 53/427

[58] Field of Search ..... 53/427, 509

[56] References Cited

U.S. PATENT DOCUMENTS

| | | | |
|---|---|---|---|
| Re. 26,494 | 12/1968 | Stocker | 206/419 |
| 2,861,404 | 11/1958 | Stratton | 53/427 |
| 2,927,409 | 3/1960 | Heyer | 53/427 |
| 2,958,172 | 11/1960 | LaBranche | 53/427 |
| 2,989,827 | 6/1961 | Groth | 53/427 |
| 3,103,774 | 9/1963 | Wall | 53/427 |
| 3,270,482 | 9/1966 | Kraut | 53/427 |
| 3,363,395 | 1/1968 | King | 53/427 |

FOREIGN PATENT DOCUMENTS

| | | | |
|---|---|---|---|
| 840949 | 7/1960 | United Kingdom | 53/509 |

*Primary Examiner*—Travis S. McGehee

[57] ABSTRACT

A method for pressure packaging of articles between a heated thermoplastic film and a substrate utilizes apparatus providing a bed platen, means for heating a thermoplastic film, means for supporting the film above the bed platen and a pressure platen having a recess in the lower surface thereof adapted to receive the article being packaged. The pressure platen and bed platen are moved relative to each other so as to deform the heated thermoplastic film into a sheath about the article and to press the heated film against the substrate outwardly of the article to effect bonding therebetween. The pressure platen desirably has a release coating thereon to prevent adhesion of the heated film thereto. Vacuum may be drawn through the bed platen and the substrate to enhance bonding of the film to the substrate.

A cooperating cutting platen includes cutting blade means and resiliently deformable material disposed therewithin so that, when the cutting platen is moved against the surface of the film and substrate to effect cutting, the resiliently deformable material bears firmly upon the still heated thermoplastic film outwardly of the article to apply further bonding pressure thereto.

6 Claims, 10 Drawing Figures

METHOD FOR SKIN PACKAGING USING PLATEN FORMING OF THE FILM, AND PACKAGES PRODUCED THEREBY

CROSS REFERENCE TO RELATED APPLICATION

The present application is a division of copending application Ser. No. 801,097 filed May 26, 1977, now U.S. Pat. No. 4,145,863 granted Mar. 27, 1979.

BACKGROUND OF THE INVENTION

Several different types of packaging systems have been evolved for display packaging of articles including blister packaging, skin packaging, and stretch and shrink film packaging. Blister and skin packaging have been particularly useful in providing relatively rigid substrates for supporting and protecting the article being packaged during storage, shipment and display.

Although blister packaging offers the advantage of using less film area, the blister must be preformed and generally of heavier gauge film so that it tends to provide less resilient deformation. Moreover, the blister generally tends to be of greater height dimension than the article being enclosed because of the difficulties in maintaining close tolerances, thus frequently permitting the article to move about within the blister. Since the area for bonding the blister to the substrate comprises a relatively narrow flange, there is sometimes a problem with respect to effecting the necessary high degree of adhesion to resist the stresses occurring during impact and the shear stresses when the articles and cartons are displayed vertically.

On the other hand, skin packaging affords significant advantages in that the film may be of considerably thinner gauge and may exhibit considerably greater tendency for resilient deformation. Moreover, the film is drawn about the article into a tight fitting sheath so that the article is restrained from movement therewithin, and the film is bonded to the substrate over substantially the entire face of the card except that portion overlain by the article. However, skin packaging can present significant problems when dealing with articles which are of varying profile height, of lesser cross section adjacent their lower ends, crushable, hollow or apertured, fibrous or bristled, etc. With articles of these types, since the hot thermoplastic film is drawn by the vacuum into a tight fitting sheath about the article, it tends to crush fibrous or other soft materials and to deform into recesses or cavities about the surface of the article and will be drawn under the area of maximum cross section of articles of irregular shape and cylinders. This can result in an aesthetically undesirable appearance or excessive reduction in the thickness of the sheath or actual damage to the product.

It is an object of the present invention to provide a novel form of skin packaging in which the sheath tightly fits about the periphery of the article but does not extend into recesses or inwardly of the area of maximum cross section.

It is also an object to provide such a skin package which is readily adaptable to articles of fibrous or soft material, or which are round or cylindrical, or which are irregular in profile, since the sheath will conform closely to the area of maximum cross section but will not deform inwardly thereof.

Another object is to provide novel method for making such unique skin packages, which method is simple and effective in operation and which may utilized simple apparatus that is rugged in construction.

A further object is to provide a novel method for making such skin packages which is readily adaptable to articles of varying configuration and of varying materials and which is relatively foolproof in operation.

SUMMARY OF THE INVENTION

It has now been found that the foregoing and related objects can be readily attained in a packaging method for encasing articles between a substrate and a deformable plastic film which utilizes apparatus having a frame and a bed platen on the frame for supporting the substrate with an article on the upper surface thereof. Film clamping means on the frame clamps a length of thermoplastic film above the bed platen and the associated substrate and article thereon. On the frame is also a heater for heating the thermoplastic film to a temperature at which it will deform under pressure, and a pressure platen supported on the frame above the film support means and the bed platen has a recess in the lower surface thereof adapted to receive therewithin the full height of the associated article. At least one of the bed platen and the pressure platen is movable realtive to the other so as to deform the heated thermoplastic film about the associated article and to press the film against the substrate outwardly of the periphery of the article so as to effect bonding thereto. Means is provided on the frame for moving the pressure platen and bed platen relative to each other to effect the desired deformation and bonding of the film and thereafter to release the package assembly.

In its preferred aspect, the pressure platen is provided with a release coating on the lower surface thereof and within the recess, and generally the pressure platen is provided with a multiplicity of article receiving recesses spaced about the lower surface thereof. The most desirable form of the apparatus is one in which there is included film transport means for moving the heated thermoplastic film along a path through the frame and the heater is supported on the frame at a point along the path spaced prior to the work station provided by the bed and pressure platens. Thus, the heated film is moved into a position between these platen members at which time the pressure forming operation takes place.

Although vacuum is not used in the forming operation, the apparatus may include means for drawing a vacuum and the bed platen may have air passages therethrough coupled to the vacuum drawing means so that air may be evacuated between the film and the substrate to facilitate bonding.

A preferred apparatus includes a first station wherein the pressure platen and bed platen are disposed and a second station including a bed platen and a cutting platen. Transport means is provided for moving the packaging assembly from the first station to the second station and there is provided means for moving the bed platen and cutting platen relative to each other. The cutting platen includes a body member, a cutting blade member supported on the body member and depending therefrom with a cutting edge at the lower end thereof defining a substantially horizontal plane, and the cutting blade means encloses an area substantially greater than the article being packaged so that it will sever the assembly of substrate, article and film along lines spaced substantially outwardly from the article.

In addition, the cutting platen includes resiliently deformable material supported on the body member and depending therefrom to at least the plane defined by the cutting edge, and the deformable material has a recess in the lower surface thereof dimensioned to receive the article of the packaging assembly. When the cutting platen and bed platen are moved towards each other and the cutting blade means effects dutting of the substrate material, the resiliently deformable material resiliently bears upon the film and substrate in the area about the article to apply bonding pressure to the still heated thermoplastic film during the cutting operation.

The resultant package includes a substrate having side margins, an article on the substrate spaced inwardly of the side margins and having a bottom portion abutting the substrate and a thermoplastic film overlying the article and the substrate. The film forms a sheath about the article abutting the substrate outwardly of the bottom portion of the article and the bottom of the sheath defines an area at least as large in dimension as the maximum area of the horizational cross section of the article.

In the method employing the apparatus, it can be seen that the substrate is supported on the bed platen and has a plurality of articles disposed is spaced relationship on the upper surface thereof. A length of thermoplastic film is heated to a temperature at which it will deform under pressure and the heated thermoplastic film is supported above the bed platen, substrate and article. A pressure platen having a plurality of recesses in its lower surface is supported above the heated film, and the pressure platen and bed platen are moved relative to each other and the supported heated film to bring the lower surface of the pressure platen surrounding the apertures therein adjacent the surface of the substrate and to deform the heated thermoplastic film into sheaths about the articles and to press the film against the substrate outwardly of the periphery of the articles so as to effect bonding thereof to the substrate about the articles.

In accordance with one aspect of the method, the heating of the thermoplastic film may render at least the lower surface portion thereof sufficiently fluid so as to effect bonding to the substrate by the substance of the molten surface portion. Alternatively, the substrate may have a heat activatable adhesive coating on the upper surface thereof and the heated thermoplastic film activates the adhesive coating upon contact therewith so as to effect bonding.

DETAILED DESCRIPTION OF THE ILLUSTRATED EMBODIMENTS

Figure 1:
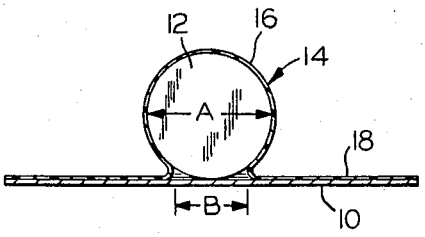
FIG. 1 is a sectional view of a skin packaged article produced in accordance with conventional skin packaging equipment and methods.

Turning now in detail to the attached drawings, there is illustrated in FIG. 1 a skin package produced in accordance with conventional techniques and generally comprised of a paperboard substrate 10, an article 12 of cylindrical cross section supported thereon, and an overlying film generally designated by the numeral 14 providing a sheath portion 16 extending about the article 12 and a planar bonding portion 18 extending along the upper surface of the substrate 10. As can be seen, the cylindrical article 12 has a maximum cross sectional dimension A represented by the diameter thereof, and the sheath 16 closesly conforms to the cylindrical periphery so that it extends inwardly of this maximum dimension and has its bottom portion abutting the substrate 10 at a point spaced well inwardly of the side margins of the article 12. As a result, the bottom of the sheath 16 defines an area represented by the dimension B considerably smaller in dimension than the maximum area of the cross section represented by the dimension A of the article 12.

As is well known, the tendency for the sheath 16 to extend under the maximum dimension of the article 12 can produce significant reduction in the thickness of the film 14 as it is drawn about the article 12 and can also produce undesirable aesthetic properties. The tendency of the film sheath 16 to follow the contour of the article 12 often limits the application of skin packaging to various apertured, fibrous and irregularly contoured articles.

Figure 2:
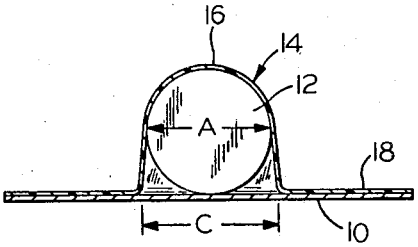
FIG. 2 is a similar sectional view of a skin packaged article produced in accordance with the method and apparatus of the present invention.

Turning now to FIG. 2, there is illustrated a skin package produced in accordance with the present invention wherein the substrate 10, article 12 and film 14 are essentially the same components as utilized in the skin package of FIG. 1. However, here the film sheath 16 can be seen to diverge downwardly from the point of maximum dimension A of the article 12 so that at the bottom the sheath 16 defines an area having a dimension C which is somewhat greater than the dimension A, and the bonding portion 18 of the film 14 thus begins along the line spaced outwardly from the periphery of the widest portion of the article 12.

Figure 3:
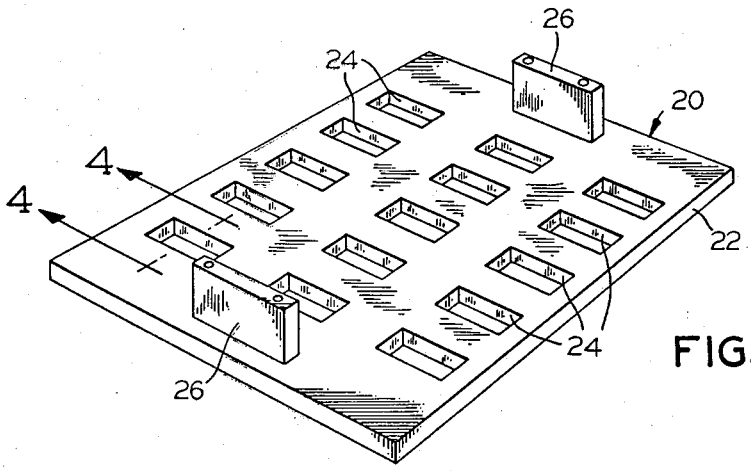
FIG. 3 is a perspective view of a pressure platen used in the method and apparatus of the present invention.
Figure 4:
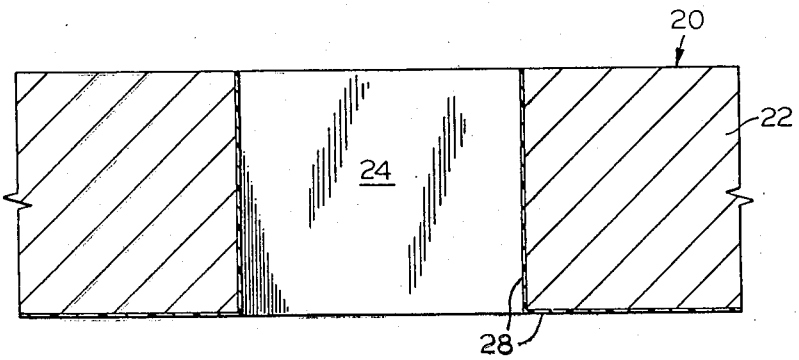
FIG. 4 is a fragmentary sectional view of the pressure platen along the line 4—4 of FIG. 3.

Turning now to FIGS. 3 and 4, a pressure platen utilized in the practice of the present invention is generally designated by the numeral 20 and includes a plate member 22 having a multiplicity of apertures 24 extending therethrough and spaced thereabout, and mounting blocks 26 extending upwardly therefrom. As seen in FIG. 4, the bottom surface and the surfaces defining the apertures 24 are provided with a release coating 28 to preclude adhesion thereto of the heated thermoplastic film 14 during the forming operation.

Figure 5:
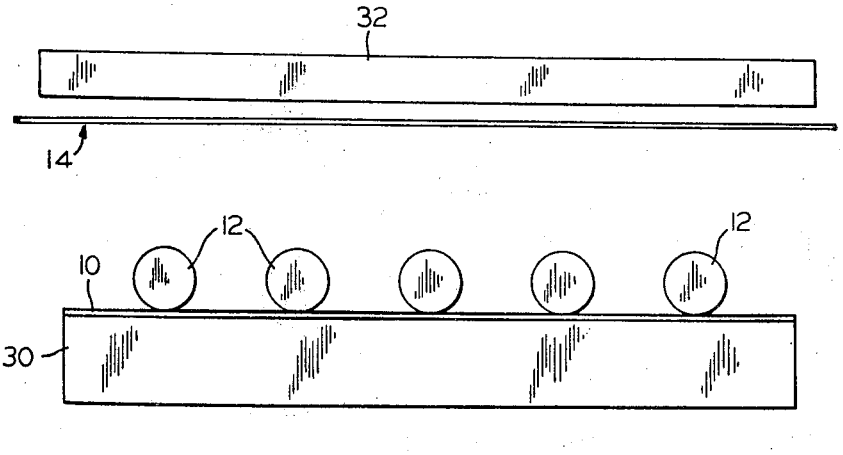
FIG. 5 is a partially diagrammatic view of the bed, substrate, a plurality of articles, a length of film and a heater at one stage in the practice of the method in the apparatus.
Figure 6:
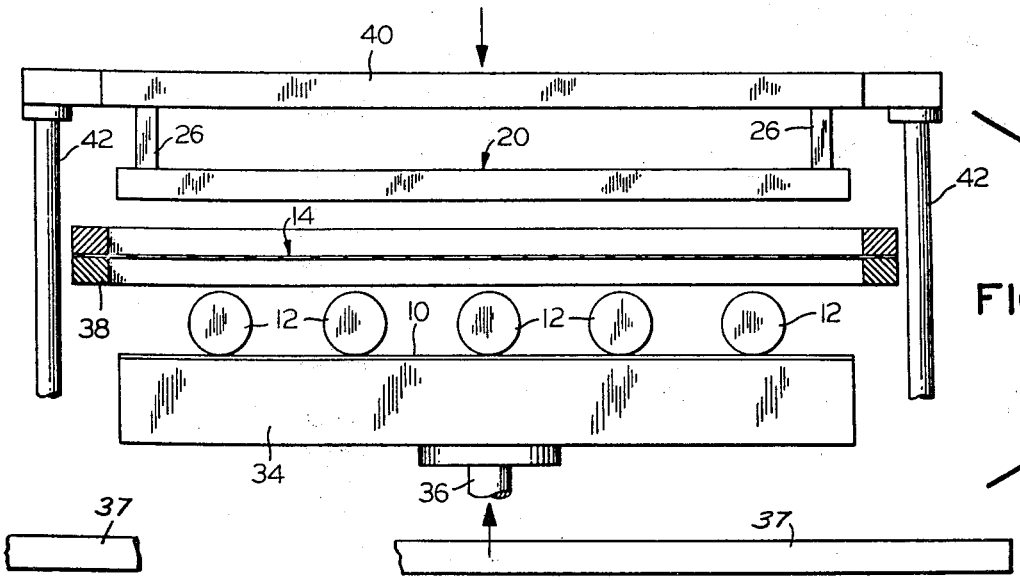
FIG. 6 is a similar view partially in section, of the next stage of the apparatus and method showing the bed platen, pressure platen, clamping frame, substrate and articles at the point where the clamping frame is in contact with the heated film and showing diagrammatically by arrows the directions of relative movement of the bed and pressure platens.
Figure 7:
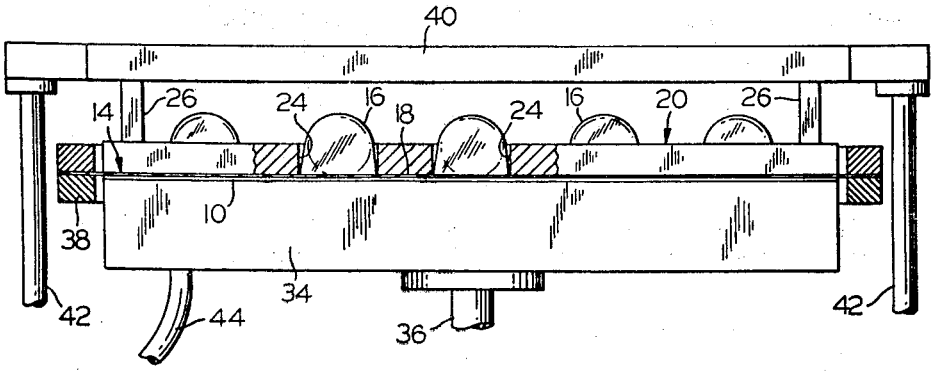
FIG 7 is a view similar to FIG. 6 after the relative movement between the bed and pressure platens has formed the film about the articles and bonded the film to the substrate to form a master card.

Turning now to FIGS. 5–7, there is diagramatically illustrated the apparatus and method of the present invention during the several stages of operation thereof. In FIG. 5, a master card or substrate 10 of relatively large area is shown as supported on a bed or conveyor 30 and has a multiplicity of articles 12 spaced about the surface thereof. A length of thermoplastic film 14 is disposed about the bed 30, substrate 10 and articles 12 and is disposed below a heater 32 which supplies sufficient heat to the film 14 to render it deformable under pressure.

In FIG. 6, the substrate 10 and articles 12 are shown as supported upon a bed platen 34 which is reciprocable vertically by the shaft 36 on the apparatus frame 37, and the now heated film is shown overlying closely the articles 12 and is clamped within the clamping frame 38 in a substantially linear configuration. The pressure platen 20 is disposed above the clamping frame 38 and its mounting blocks 26 are mounted upon the support member 40 which is reciprocable vertically upon the shafts 42. Thus, the bed platen 34 and pressure platen 20 may be moved relative to each other and the clamping frame 38 while the film is still in the substantially linear configuration to effect deformation of the film 14 within the clamping frame 38 about the articles 12.

In FIG. 7, the pressure platen 20 has been moved downwardly and the bed platen 34 has been moved upwardly by the drive mechanism (not shown). As a result of this relative movement, the heated thermoplastic film 14 within the clamping frame 38 has been formed downwardly about the articles 12 to form a series of sheaths 16, and the sheaths 16 and articles 12 extend upwardly through the apertures 24 is the pressure platen 20. As the pressure platen 20 reaches the end of its movement relative to the bed platen 34, the heated film 16 now extends in planar relationship between the articles 12 and is bonded to the substrate 10 by the pressure to provide the bonding portion 18. As seen, the apertures 24 are of greater dimension than the articles 12 so as to provide a clearance thereabout and ensure a sheath 16 which has its bottom portion spaced outwardly from the maximum peripheral dimension of the articles 12.

After the film 14 has been contacted with the substrate 10, vacuum may be drawn through the line 44 which is connected to a source of vacuum (not shown) and to the bed platen 34 so as to evacuate any air between the film 14 and substrate 10 is the area of planar abutment. This draws the film 14 downwardly tightly against the substrate 10 in cooperation with the pressure effected by the pressure platen 20 and, depending upon the film employed, may cause a molten portion of the lower surface of the film 14 to penetrate into the pores of a porous, air pervious substrate 10 to effect bonding therebetween. After a short dwell time, the bed platen 34 and pressure platen 20 are moved relative to each other to release the master card which has now been produced for discharge or transfer to a succeeding station.

Figure 8:
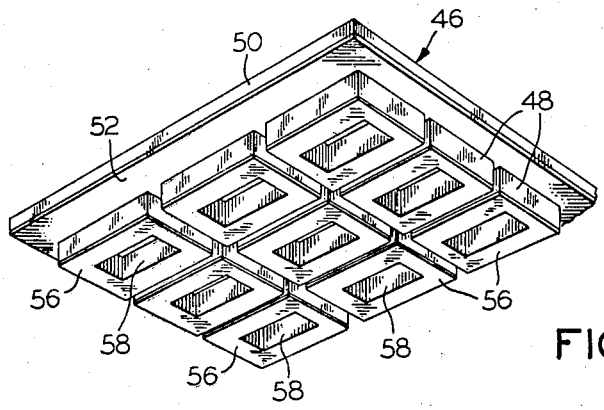
FIG. 8 is a fragmentary bottom perspective view of a cutting platen used in the apparatus and method of the present invention.
Figure 9:
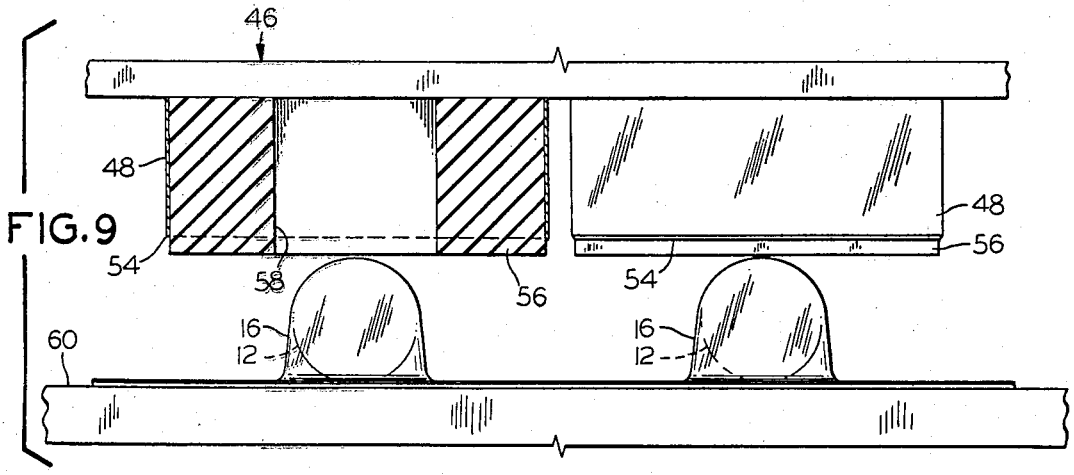
FIG. 9 is a fragmentary, partially diagrammatic view of the cutting platen, bed platen and master card prior to relative movement of the platens to effect cutting thereof.
Figure 10:
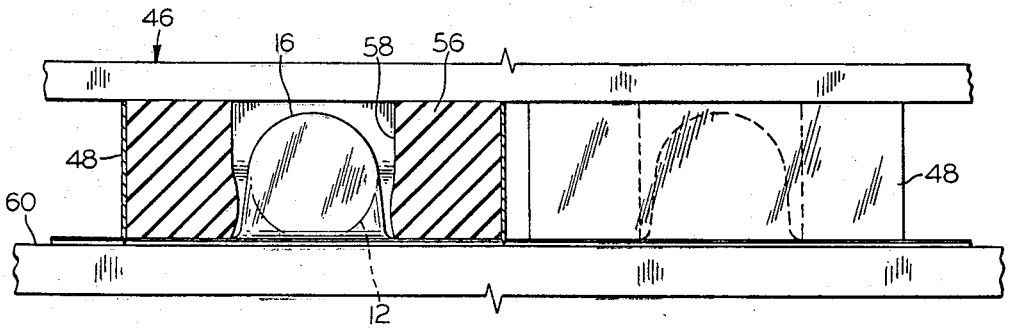
FIG. 10 is a view similar to FIG. 9 after relative movement of the platens to effect cutting of the master card.

In accordance with a highly desirable aspect of the present invention, the skin packaging assembly master card produced in FIG. 7 is then transferred to a die cutting station wherein there is provided a cutting platen of the type illustrated in FIGS. 8-10 and generally designated by the numeral 46. The cutting platen 46 includes a multiplicity of cutting blades 48 of generally rectangular configuration arranged in a spaced grid pattern and supported upon the metal plate member 50 and backing member 52. As a result, the spacing between the rectangular cutting plates 48 will provide a skeletal web of substrate 10 and film 14 when the master card is cut. As best seen in FIGS. 9 and 10, the cutting blades 48 have cutting edges 54 lying in a horizontal plane. Mounted on the cutting platen 46 within the area defined by the cutting blades 48 are resiliently compressible members 56 which extend slightly below the plane defined by the cutting edges 54 and which have apertures or recesses 58 therein greater in dimension than the sheaths 16.

When the cutting platen 46 is moved downwardly against the master card now supported on the bed platen 60, the resiliently compressible members 56 bear upon the upper surface of the film 14 to apply further bonding pressure to the planar bonding portion 18 as the cutting edges 54 sever the film 14 and substrate 10. Following the cutting of the master card, the cutting platen 46 is moved away from the bed platen 60 and the web and individual skin packaging units may be discharged from the apparatus.

The substrate will generally comprise paperboard which is coated or uncoated depending upon the means of effecting adhesion of the film thereto. Various processes do employ paperboard coated with an adhesive which is tacky at the time the substrate is fed into the machine or which is heat activatable, i.e., one which is rendered tacky and adherent by the heat to which the paperboard surface is exposed within the skin packaging machine or at the time of contact with the heated plastic film. The thickness of the paperboard will be dependent upon the weight of the article which is to be supported, aesthetic properties, etc.

When vacuum is to be utilized to improve the bonding of the plastic film in the bonding area outwardly of the sheath, especially by drawing the molten portion of the surface of the film into the pores of the paperboard as described in Kraut U.S. Pat. No. 3,031,072, granted Apr. 24, 1962, the porosity of the board may be blocked in the zrea underlying the sheath so as to avoid collapsing the sheath and drawing it tightly about the product as has occurred in pre-existing skin packaging processes. However, it has been found that a reduction of the vacuum to about 10–15 percent of that conventionally employed for skin packaging, will provide the necessary bonding of the film by its own substance while at the same time avoiding the drawing of the sheath thightly about the contours of the article itself.

The thermoplastic film may be comprised of any suitable thermoplastic resin which is rendered sufficiently deformable to the desired temperature within the machine and providing the desired aesthetic and bonding properties. When adhesive coatings are employed upon the substrate, film such as polyvinyl chloride, polyvinylidene chloride, polyethylene, polypropylene, polyethylene/ionomer type films, laminated films of different polymers, etc. Again, from the standpoint of economy, the film can be bonded by its own substance as described in the aforementioned Kraut patent when surface treated polyolefins or polyolefin-/ionomer films are employed. The gauge of the film may range from as little as one mil to twenty mils or even more.

As previously indicated, various articles may be packaged by the apparatus and method of the present invention since the sheath is not drawn tightly around irregular contours, or under the article, or into recesses or around fibers, etc. The sheath formation is readily controlled by means of the pressure platen and the dimensioning and configuration of the apertures in the pressure platen relative to the dimensions and configuration of the article. If so desired, heat shielding may be employed in the area overlying the film which is to form the sheath so that the bulk of this area remains relatively cool and is not so readily formed into close contour abutting relationship with the article being packaged; however, this has not been found necessary for most applications.

Articles of irregular contour or articles which tend to roll or otherwise move about the paperboard substrate may be held in position by pins projecting through the substrate, on the platen or support underlying the substrate, by adhesive or tape upon the substrate, or by magnets within the underlying substrate support.

In the illustrated embodiment, the pressure platen is shown as fabricated from metal since this also permits the platen to function as a heat sink and rapidly cool the previously heated film as soon as the film has been deformed into the sheath and into the bonding area. However, it will be appreciated that the platen may also be fabricated from high temperature resins, ceramics, or other materials. To minimize the likelihood of possible adhesion of the film to the pressure platen when metal is employed, it is desirably coated with a release coating such as a silicone or tetrafluoroethylene coating.

In the illustrated embodiment, the platen has been shown to be of a thickness less than the full vertical height of the articles being packaged since this can provide the necessary rigidity for the forming operation while at the same time minimizing the amount of weight required therefor. As a result, the recesses for receiving the articles extend through the full thickness of the pressure platen allowing the articles to project therethrough and above the plane of the upper surface of the platen. Alternatively, the platen may be of a thickness so that the recesses do not extend therethrough and the articles are received within the depth thereof. As used herein, the terminology "a recess in the lower surface thereof adapted to receive therewithin the full height of the associated article" is intended to encompass either a recess which extends only through a portion of the thickness of the pressure platen or a recess which comprises an aperture extending through the full thickness of the pressure platen so as to allow the article to project thereabove.

The bed platen used in cooperation with the pressure platen may be solid, i.e., impervious to air, or it may be provided with air passages to render it pervious to passage of air when it is intended to use vacuum to facilitate or augment bonding of the film to the substrate. Such previous platens have been employed in conjunction with conventional skin packaging processes where vacuum is used to form the film, but the amount of vacuum drawn therethrough may be reduced since the forming of the sheath is accompanyed by the pressure platen. To minimize the possibility of deforming the sheath closely about irregular contours of the product, the bed platen may omit vacuum holes in the area underlying the product and the intended area of the sheath.

Depending upon the type of apparatus employed, the heater may be a stationary heater under which the film moves as it passes from a feed roll support to a forming station, or the heater may be one which is moved inwardly and outwardly from a position overlying the film when there is but one operating station. To ensure proper formation of the film, the margins of the heated film should be clamped securely conveniently in a typical clamping frame which may be omitted in the event that cooperating portions on the pressure platen and the bed platen provide clamping surfaces which engage the film before forming pressure is applied thereto.

In high speed equipment, the pressure forming station will be but one of several stations along the path of travel of the film and substrate through the machine. Heating of the film will occur prior to the pressure forming station and the film will advance through the pressure forming station where, when clamped, the pressure platen and the bed platen will be moved relative to one another to effect formation of the film and bonding to the substrate.

It will be appreciated that both pressure platen and bed platen may be moved towards each other or that either one of the members may be stationary while only the other is moved. Either type of forming equipment is satisfactory for the practice of the invention.

The cutting platen of the present invention is based upon conventional die cutting construction wherein blade members are supported upon a base plate and arranged and dimensioned to cut the master card at a point spaced well outwardly from the article packaged. In some cutting operations, the blade members will be fabricated as a closed grid, i.e., they will intersect each other, so that there is no scrap or web between the individual cards when cut. However, the more rapidly operating continuous or semicontinuous packaging equipment uses a grid which is open, i.e., wherein the blades are arranged as spaced apart rectangles to sever individual packages so that they leave a skeletal web of the substrate. As used herein, the term "grid" includes either a closed grid or an open grid as above described.

Disposed within the confines of the cutting blade is resiliently deformable material haing a recess configured to received the article and its associated sheath. In practice, this recess is sufficiently larger than the artice and its associated sheath so that, when the resiliently deformable material does deform resiliently under pressure, it will not bear upon and deform the sheath. As illustrated in the drawings, the resiliently deformable material extends to at least the plane of the cutting blade edge so that it will deform and apply substantial bonding pressure during the cutting operation in the bonding area of the film and substrate. Projection of 1/16 to ¼ inch beyond this plane has been found to be highly advantageous in providing the desired bonding pressure as the material deforms during the stroke of the cutting platen.

The resiliently deformable material is conveniently a polyurethane resin, silicone rubber resin, neoprene rubber resin, or other resinous material providing the desired resiliently deformable properties, resistance to the elevated temperature of the film and low adhesion to the film. If so desired, the resiliently deformable material may have a coating of a release agent such as a silicone resin.

Thus, it can be seen from the foregoing detailed specification and claims that the apparatus and method of the present invention provide a novel and highly advantageous skin package wherein the sheath is formed by pressure and excessive deformation, thinning and underextension are avoided. The resultant package is attractive and readily adapted to utilization for articles which heretofore have presented substantial problems in skin packaging operations. The apparatus may be fabricated from relatively economical and rugged parts and is simple and highly effective in operation.

Having thus described the invention, I claim:

1. In a method for encasing articles between a substrate and a deformable plastic film, the steps comprising:

a. supporting on a bed platen a substrate having a plurality of articles spaced about the upper surface thereof:

b. heating a length of theremoplastic film to a temperature at which it will deform under pressure;

c. supporting said heated thermoplastic film is a substantially linear configuration above said bed platen, substrate and articles;

d. providing a pressure platen having above said supported heated film a generally planar lower surface with a plurality of recesses therein dimensioned to receive therewithin the full height of said articles; and e. moving said pressure platen and bed platen relative to each other and said supported heated film while said film is of substantially linear configuration to bring said lower surface of said pressure platen about said apertures therein adjacent the surface of said substrate about each of said plurality of aritcles and to deform said heated thermoplastic film from said substantially linear configuration into sheaths about each of said articles and to press said film against said substrate outwardly of the periphery of each of said articles and thereby effect bonding thereof to said substrate about each of said articles.

2. The method in accordance with claim 1 wherein said heating of said thermoplastic film renders at least the lower surface portion thereof sufficiently fluid so as to effect bonding of said film to said substrate by the substance thereof.

3. The method in accordance with claim 1 wherein said substrate has a heat activatable adhesive coating on the upper suface thereof about said articles and wherein said heated theremoplastic film actuates said adhesive coating upon contact therewith so as to effect bonding of said film to said substrate.

4. The method in accordance with claim 1 wherein said substrate and said bed platen are pervious to air and a vacuum is drawn therethrough cooperating with said pressure platen to effect bonding of said film to said substrate.

5. The method in accordance with claim 4 wherein said substrate is of porous paperboard and wherein said heating of said theremoplastic film renders at least the lower surface portion thereof sufficiently fluid so as to effect bonding of said film to said substrate by the substance thereof penetrating into the pores of said substrate.

6. In a method for encasing articles between a substrate and a deformable plastic film, the steps comprising:

a. supporting on a bed platen a substrate having a plurality of articles spaced about the upper surface thereof;

b. heating a length of thermoplastic film to a temperature at which it will deform under pressure;

c. supporting said heated thermoplastic film in a substantially linear configuration above said bed platen, substrate and articles;

d. providing a pressure platen having above said supported heated film a generally planar lower surface with a plurality of recesses therein dimensioned to receive therewithin the full height of said articles;

e. moving said pressure platen and bed platen relative to each other and said supported heated film while said film is of substantially linear configuration to bring said lower surface of said pressure platen about said apertures therein adjacent the surface of said substrate about each of said plurality of articles and to deform said heated thermoplastic film from said substantially linear configuration into sheaths about each of said articles and to press said film against said substrate outwardly of the periphery of each of said articles and thereby effect bonding thereof to said substrate about each of said articles;

f. placing the assembly of deformed film, substrate and article upon a bed platen while said thermoformed film is still hot;

g. providing a cutting platen having depending cutting blade means with a cutting edge at the lower end thereof and enclosing an area substantially greater than said article, said cutting platen also including deformable material within the area defined by said cutting blade means and extending downwardly to at least the plane defined by the cutting edge of said cutting blade means; and h. moving said cutting platen and said bed platen relative to each other to cause said cuttin edge of said cutting blade means to sever said film and substrate and to concurrently cause said resiliently deformable material to press upon the upper surface of said heated film and thereby apply bonding pressure to the film and underlying substrate.

* * * * *

UNITED STATES PATENT AND TRADEMARK OFFICE

CERTIFICATE OF CORRECTION

PATENT NO. : 4,219,987

DATED : September 2, 1980

INVENTOR(S) : JAMES V. HANNON

It is certified that error appears in the above-identified patent and that said Letters Patent are hereby corrected as shown below:

Column 9, line 15, "is" should be -- in --

Column 9, line 28, "aritcles" should be -- articles --

Column 10, line 46, "cuttin" should be -- cutting --

Signed and Sealed this

*Twenty-seventh* Day of *January 1981*

[SEAL]

*Attest:*

RENE D. TEGTMEYER

*Attesting Officer*

*Acting Commissioner of Patents and Trademarks*